United States Patent [19]

Bahm

[11] Patent Number: 4,878,685

[45] Date of Patent: Nov. 7, 1989

[54] WHEELCHAIR WORK TRAY

[75] Inventor: Glenn A. Bahm, Houston, Tex.

[73] Assignee: Mobility Work Trays, Inc., Houston, Tex.

[21] Appl. No.: 245,459

[22] Filed: Sep. 16, 1988

[51] Int. Cl.[4] ..... A63D 5/00

[52] U.S. Cl. ..... 280/304.1; 108/90; 248/231.3; 297/162

[58] Field of Search ..... 297/135, 161, 162; 108/90; 248/225.31, 231.2, 231.3; 280/289 WC, 289 A, 304.1, 304.5

[56] References Cited

U.S. PATENT DOCUMENTS

| | | | |
|---|---|---|---|
| 3,016,225 | 1/1962 | Hughes et al. | 248/231.3 X |
| 4,300,798 | 11/1981 | Musgrove et al. | 297/162 X |
| 4,674,722 | 6/1987 | Danby et al. | 248/231.3 |
| 4,679,756 | 7/1987 | Wood | 297/161 X |
| 4,753,449 | 6/1988 | Doucet | 280/289 WC |
| 4,767,131 | 8/1988 | Springer et al. | 280/289 WC |
| 4,779,884 | 10/1988 | Minati | 280/289 WC |

OTHER PUBLICATIONS

Three pages from a Wheelchair catalogue showing Wheelchair Work Trays.

*Primary Examiner*—Charles A. Marmor
*Assistant Examiner*—Michael Mar
*Attorney, Agent, or Firm*—Hovey, Williams, Timmons & Collins

[57] ABSTRACT

A wheelchair work tray multipivotal mounting assembly may be easily mounted and removed from a wheelchair and is adapted to receive a multipivotal mount for use by wheelchair occupants. The mounting assembly is adapted for mounting over one arm of a wheelchair and includes a pair of plates adapted for sliding over a wheelchair arm. Once positioned on the arm, the mounting assembly may be locked into place by a locking assembly including a lever operated cam. The cam secures the mounting assembly to the wheelchair arm and resists displacement or rotation in any direction. A receiver accepts a multipivotal mount supporting a tray and enables vertical adjustment and rotation of the multipivotal mount about a vertical axis. The mounting assembly may be removed by rotating the lever counterclockwise and swinging the locking assembly outward.

17 Claims, 4 Drawing Sheets

WHEELCHAIR WORK TRAY

BACKGROUND OF THE INVENTION

1. Field of the Invention

The present invention is broadly concerned with a releasable tray mounting assembly for a wheelchair. The mounting assembly is particularly suited to receive a multipivotal tray mount, thereby enabling those persons confined to a wheelchair to draw, eat and read from the tray in a position which is most comfortable. The mounting assembly is removably mounted to the arm of a conventional wheel chair by pivoting a lever attached to a cam which quickly and securely attaches the mounting to the wheelchair.

2. Description of the Prior Art

Many of those who use a wheelchair are often confined to it for many hours during the day. As such, the wheelchair occupant must perform many of his or her normal, everyday tasks while seated in the same chair. Not only eating but occupational therapy, work and hobbies must be performed from the wheelchair.

While these different tasks may require the presentation of a variety of objects to the wheelchair patient, present means of mounting trays to a wheelchair provide no variety of presentation or adjustment in the wheelchair. The work tray is often a lightweight metal, fiberglass or synthetic resin surface with a crescent shape to allow mounting on the wheelchair and permit objects laced thereon to be easily reached by the patient. However, these trays must be very close to the occupant to have adequate support, which is confining and restrictive in movement and activity for the patient.

Prior trays are mounted to the wheelchair tray by hook and pile fabric straps which wrap around the wheelchair arms. Other mounting devices include curved metal tubing secured to the wheelchair for attachment of the tray by thumb screws. Both types of mounting generally require the wheelchair occupant to seek assistance in mounting the tray to the wheelchair. The prior tray mounts require removal from the wheelchair whenever an occupant gets up or sits down.

The prior tray mountings serve to support items in a flat plane but lack the ability to adjust to various working heights, pivot for various work positions or swivel away from the front of the wheelchair. The present mountings make it cumbersome to remove and reattach the trays when the occupant leaves the wheelchair or otherwise desires that the tray be removed from the wheelchair. Because the tray must be removed entirely when not in use, trays must often be retrieved from various and remote rooms in a home, hospital or nursing facility when again needed.

SUMMARY OF THE INVENTION

The wheelchair work tray multipivotal mounting assembly hereof overcomes these problems by providing a tray mounting which is easily mounted and removed from a conventional wheelchair. Accordingly, it is one object of this invention to provide a tray mounting assembly which is lightweight and easy to secure and remove from a wheelchair.

It is another object of the invention to provide a tray mounting assembly which enables a tray to be pivoted to a variety of angles, is adjustable vertically to accommodate the occupant, and may be swiveled out of the way for easy exit from the wheelchair without removal from the tray.

Another object of the invention is to provide a tray mounting assembly which enables a tray to remain unobstrusively mounted to the wheelchair when not in use and in fact enables a work tray to be swiveled for use as, e.g., a dressing table when the patient is out of the wheelchair.

Another object of the invention is to provide a tray mounting assembly which may be mounted to a conventional wheelchair without any modifications thereto, and may be economically constructed.

Other objects and advantages of the invention will become more apparent from the following description and the accompanying drawings.

To accomplish these objects, a wheelchair work tray multipivotal mounting assembly is provided which enables a wheelchair occupant to quickly and easily secure the assembly to a wheelchair by sliding the tray mounting assembly over the wheelchair arm and swinging a lever to lock the tray mounting assembly into place. The tray mounting assembly preferably includes a receiving tube which permits a conventional photographic swivel head having a post to be slidably mounted thereon.

The structure of the tray mounting assembly includes a pair of spaced metal plates adapted to slide over and engage the arm of a wheelchair. A camming device for locking the tray mounting assembly in position is swingably mounted on a hinge to the outboard plate to permit easy attachment of the tray mounting assembly to a wheelchair arm.

DESCRIPTION OF THE PREFERRED EMBODIMENT

Figure 1:
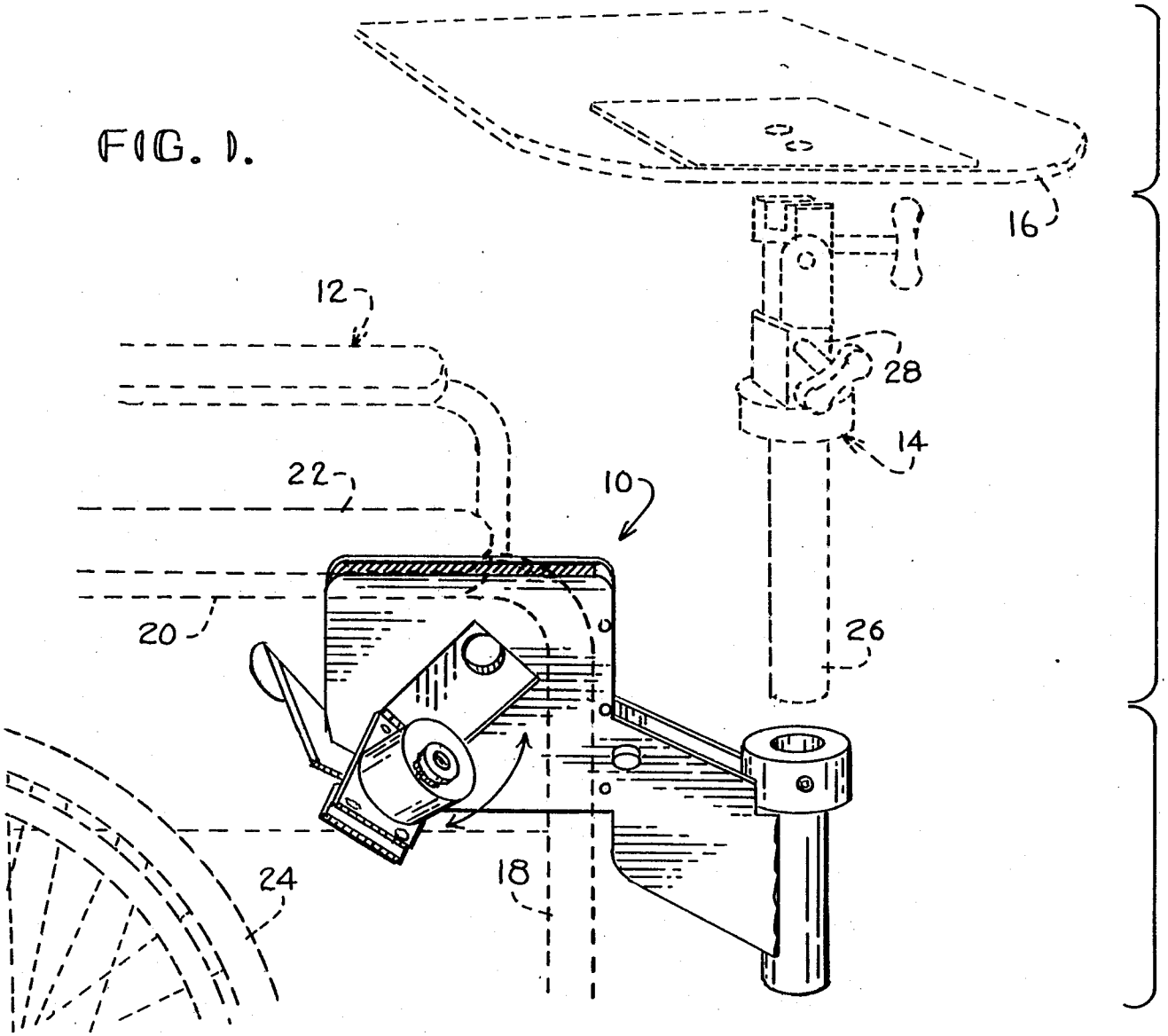
FIG. 1 is a perspective view of the mounting assembly oriented for mounting on a wheelchair and adapted for receiving a multipivotal tray mount and tray.

Referring now to the drawings, a wheelchair work tray multipivotal mounting assembly 10 is shown in FIG. 1 in position on wheelchair 12 and adapted to receive a multipivotal mount 14. The multipivotal mount 14 is especially useful for supporting a work tray 16. The wheelchair 12 is of a conventional type having a tubular frame 18 including arms 20 which support arm rests 22 and a large wheel 24 for propulsion of the wheelchair 22.

The multipivotal mount 14 includes stem 26 and head 28. Head 28 is substantially the pivotal component of a standard photographic tripod adapted for swiveling or pivoting an item mounted thereon to a desired position and then capable of locking when oriented into the desired position. The work tray 16 is removably mounted to the head 28 by bolts, thumbscrews or the like.

Figure 2:
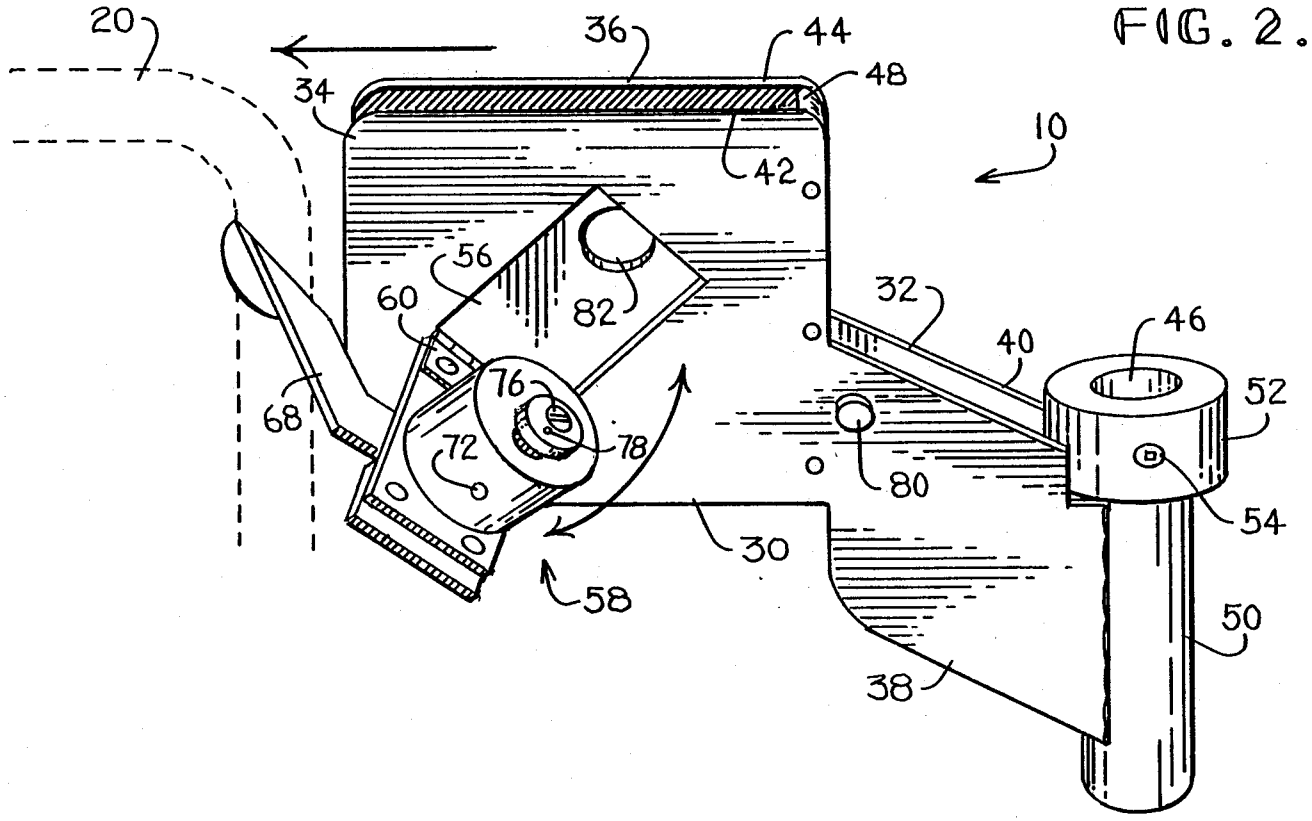
FIG. 2 is a perspective view of the mounting assembly prior to mounting showing the locking mechanism in an open position.

Turning now to FIG. 2, the mounting assembly 12 includes a pair of spaced apart plates 30 and 32. First plate 30 is oriented to mount on the outboard side of the wheelchair arm 20 while second plate 32 is located on the inboard side of the arm 20. Each of the plates 30 and 32 are preferably stamped or cut of a single metal sheet and have first clamp portion 34 and second clamp portion 36, and first extension portion 38 and second extension portion 40. The plates 30 and 32 are spaced apart substantially the same distance as the outside diameter of arm 20.

The top marginal edge of clamp portion 34 is bent toward plate 32 to create a flange 42, while top marginal edge of clamp portion 36 is bent toward plate 30 to create a second opposing flange 44.

The plates 30 and 32 are joined by barrier 48 and sleeve 50. Barrier 48 spans the distance between clamping portions 34 and 36 and is joined to the plates 30, 32 by screws or rivets. Sleeve 50 is tubular and is welded to the ends of extension portions 38 and 40 distal from clamping portions 34 and 36. Receiver 52 is mounted on top of and has a bore 46 which is co-axial with the bore of sleeve 50 so as to be adapted to receive stem 26 therein. A set screw 54 is threadably inserted through the side of receiver 52 so as to engage stem 26 when inserted into receiver 52.

As shown in FIG. 2, first plate 30 defines a rectangular access 56 therethrough and adapted to receive locking assembly 58. Locking assembly 58 is swingably mounted by rivets on hinge 60 to first plate 30. The access 56 is covered by door 62 when the locking assembly is in the closed position, and door lip 64 riveted to door 62 prevents the door 62 from swinging beyond the access 56 into the area between plates 30 and 32.

Figure 7:
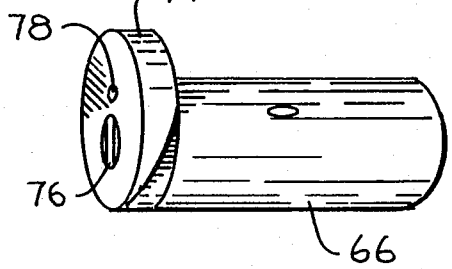
FIG. 7 is a perspective view of the axle showing the eccentric for locking of the door.

An axle 66 extends through an opening in door 62 and is welded to lever arm 68. Axle 66 is mounted for free pivoting relative to door 62. A cam 70 is secured to axle 66 by set pin 72 pushed through an aligned hole in the cam 70 and the axle 66. The cam 70 is shown to be substantially circular and mounted offset with respect to its center, but may be oblong or elliptical. Cam 70 is thus fixed relative to axle 66 but pivotally mounted with respect to plates 30, 32. As shown in FIG. 7, eccentric 74 is attached to axle 66 by screw 76 and held in place by stabilizing pin 78. Eccentric 74 and cam 70 are spaced apart on axle 66 roughly the same distance as the thickness of plate 32.

A bullet catch 80 is mounted on first plate 30 in a position to hold lever arm 68 against counterclockwise rotation when lever arm 68 is rotated to hold cam 70 in a locking position. The catch 80 is preferably spring loaded, but the lateral resiliency of lever arm 68 enables it to be lifted over catch 80 when the catch 80 is not spring loaded Plate 32 defines an opening 82 sized and positioned to receive eccentric 74 therethrough when lever arm 68 is in an open position but engages eccentric 74 when lever arm 68 is pivoted to a closed position.

Figure 3:
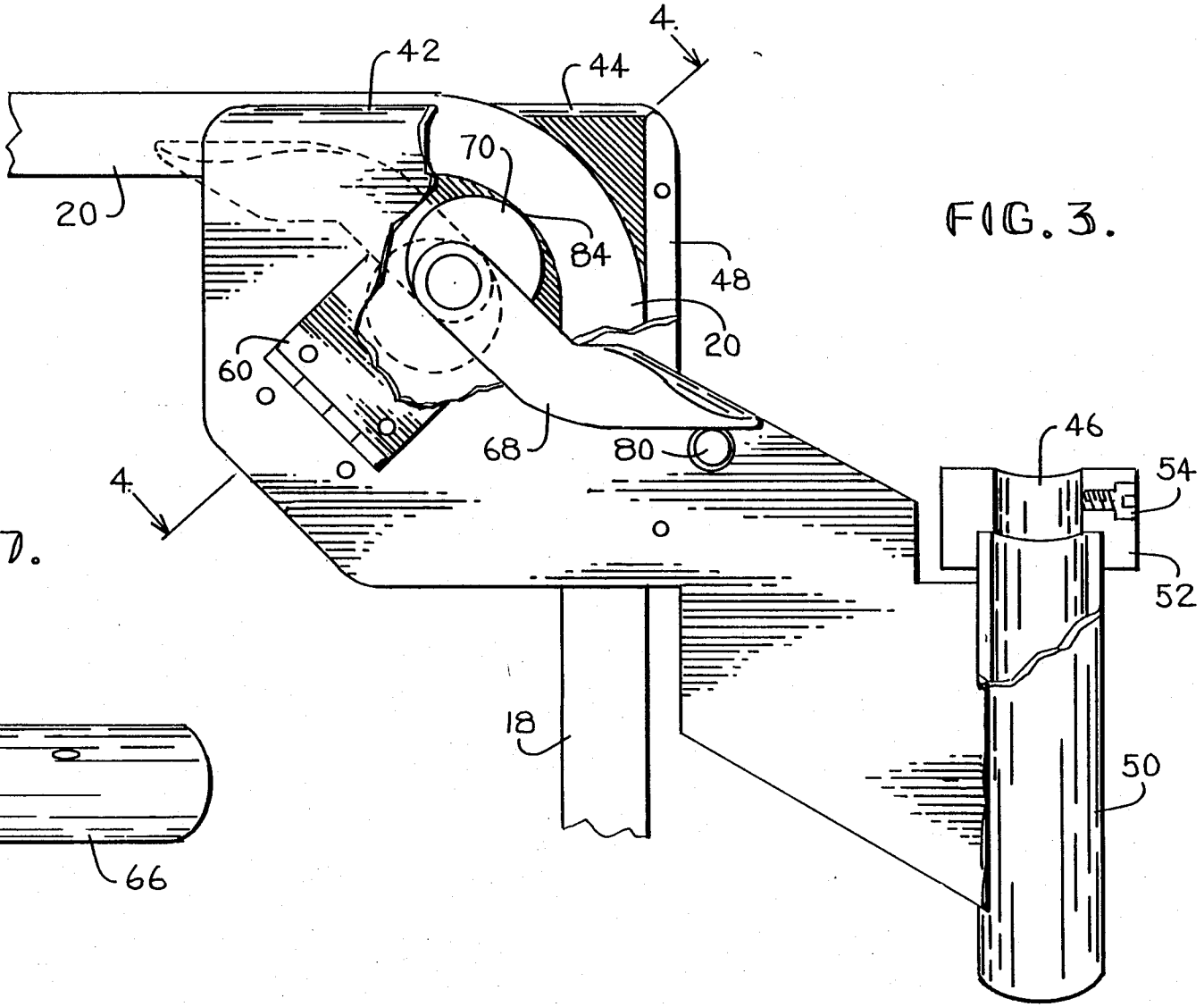
FIG. 3 is a perspective view of the mounting assembly in a locked position with a portion of the side plate and hinge door removed to show the locking assembly inside the mounting.
Figure 6:
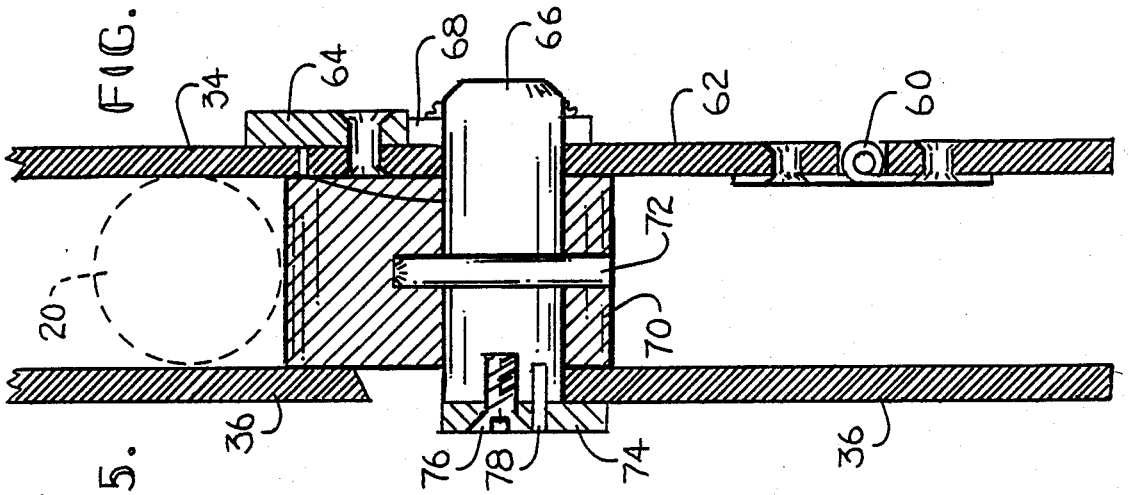
FIG. 6 is a vertical sectional view as in FIG. 5 showing the locking mechanism pivoted into a locked position.
Figure 5:
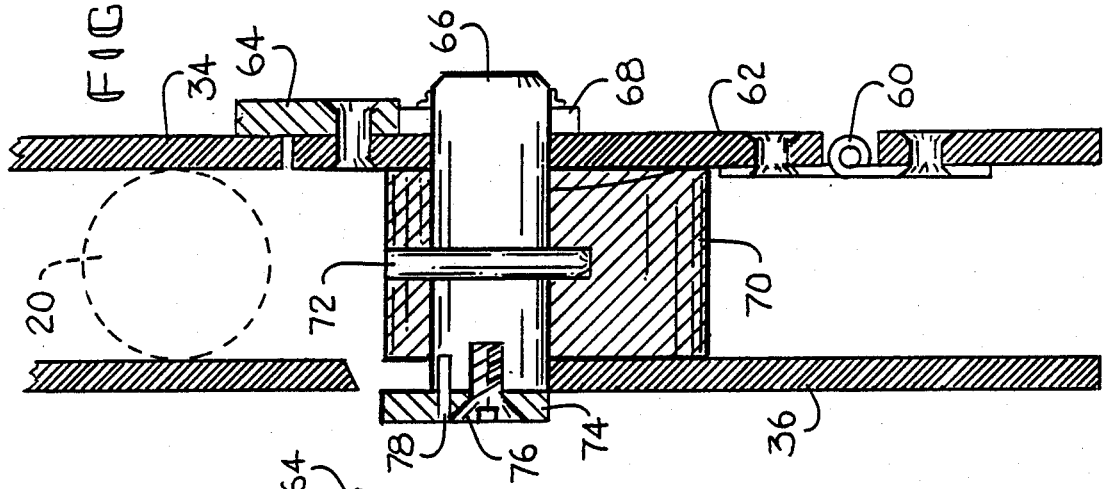
FIG. 5 is a sectional view as in FIG. 4 showing the hinged door closed and the locking assembly prior to pivoting into a locked position.
Figure 4:
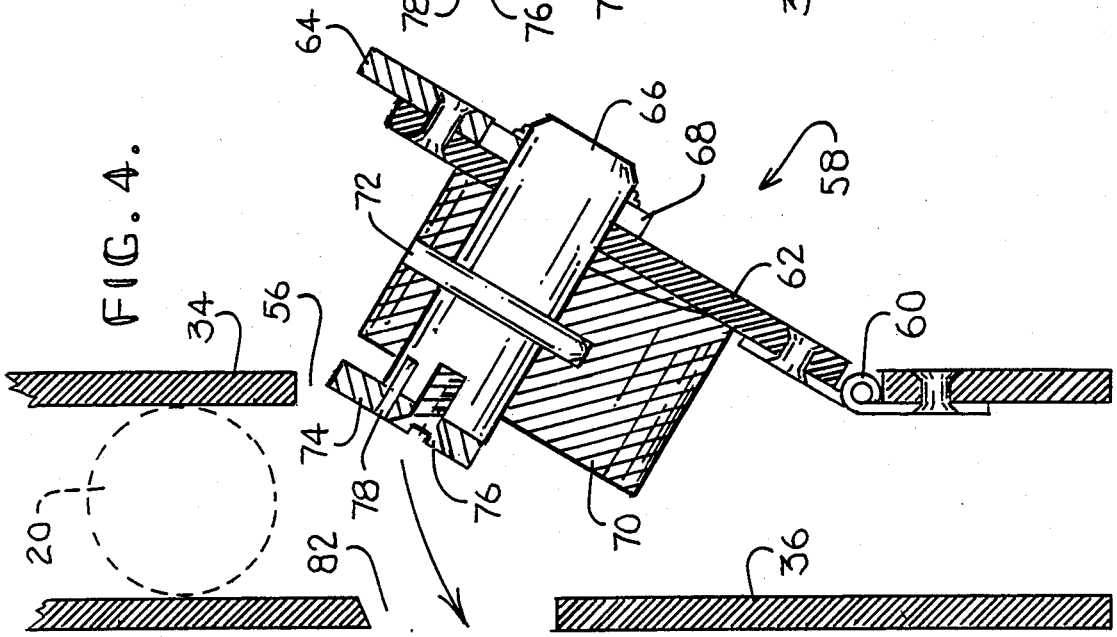
FIG. 4 is a sectional view along line 4—4 showing the hinged door carrying the pivotal locking assembly.

Turning now to FIGS. 4, 5 and 6, the locking assembly 58 is shown in cross-section so as to show the mounting in first an open, then shut, and finally a locked position. In FIG. 4, the locking assembly 58 is shown swinging into locking position on hinge 60. As door 62 closes, eccentric 74 passes through opening 82, and into the position shown in FIG. 5. The eccentric 74 and cam 70 are sufficiently spaced on axle 66 that, when axle 66 is rotated, eccentric 74 engages wall 36 and locks the door 62 closed, as shown in FIG. 6. Simultaneously, the cam 70 rotates into locking position so that the assembly 10 is held firmly with respect to arm 20. FIG. 3 illustrates the movement of cam 70 into locking position, from an open position shown in phantom to a closed position shown just prior to locking of the lever arm 68 behind the catch 80.

In the closed and locked position, cam 70 is maintained in tension against arm 20 by the opposing members of the mount 10 and wheelchair 12. As shown in FIG. 3, flanges 42 and 44 act on arms 20 and are opposed by cam 70, while cam 70 also acts on the vertical portion of arm 20 extending downward to become a part of frame 18 and opposes barrier 48. By its placement at the curve 84 of arm 20, cam 70 acts on both the horizontal and vertical components of arm 20. Mount 10 also resists lateral movement or rotation as plates 30, 32 are positioned relatively outboard and inboard to arms 20. Thus, when locked, the assembly 10 is resistant to movement in any direction but adapted to receive multipivotal mount 14 which is adjustable to accommodating a wheelchair occupant.

The mounting assembly 10 is easily mounted on the arm 20 of the wheelchair. The door 62 is first swung outboard and away from the frame 18 so that the assembly 10 may be positioned on the arm. The assembly 10 is moved rearwardly as shown by the arrow in FIG. 2 until the barrier 48 contacts frame 18 and the flanges 42, 44 rest on arm 20.

Once properly positioned as shown in FIG. 3, the door 60 is closed and the lever 68 rotated in a clockwise direction until cam 70 engages curve 46 and lever arm 68 is locked behind catch 80. Stem 26 is then inserted into receiver 52 and secured by set screw 54. Tray 16 may then be attached to head 28 of multipivotal mount 14 by screws, bolts or thumbscrews as provided on or with the head 88. Loosening of set screw 54 permits vertical adjustment of the tray 16 or enables the tray to be swiveled out of the way before the set screw 54 is retightened.

To remove the mounting assembly 10, the tray 16 and multipivotal mount 14 are removed from receiver 52 by loosening set screw 54. The lever arm 68 is then pulled over catch 80 and rotated counterclockwise to release cam 70 from engagement with arm 20 and frame 18 and to move eccentric 74 out of engagement with clamp portion 36. When the door 62 is swung outwardly on hinge 60, the locking assembly 58 swings with it.

I claim:

1. A wheelchair work tray multipivotal mounting assembly adapted for mounting to a wheelchair or the like, said wheelchair having an armrest assembly including a normally substantially horizontal component and a normally substantially vertical component positioned in converging orientation with respect to said substantially horizontal component, said mounting assembly comprising;

mounting means for mounting over said armrest assembly including a pair of interconnected, spaced apart members adapted to receive said substantially horizontal and said substantially vertical components therebetween, said mounting means including barrier means oriented for simultaneous abutting engagement with both said substantially horizontal component and said substantially vertical component of said armrest assembly;

pivotally mounted, transversely extending, selectively actuatable locking means oriented for abutting said armrest assembly proximate an area of convergence of said substantially vertical and substantially horizontal components and for exerting a clamping force in combination with said barrier means simultaneously on both said substantially horizontal component and said substantially vertical component; and means for releasably receiving a supporting mount.

2. A wheelchair work tray multipivotal mounting assembly as set forth in claim 1, said arm presenting a width, said spaced apart members comprising first and second plates oriented for mounting respectively inboard and outboard of said arm and spaced apart substantially the width of said arm.

3. A wheelchair work tray multipivotal mounting assembly as set forth in claim 2, said locking means being oriented on said mounting means such that when said vertical and horizontal components are interconnected at an intersection, said locking member is oriented below said horizontal component and rearward of said vertical component.

4. A wheelchair work tray multipivotal mounting assembly as set forth in claim 3, said mounting means including structure engaging said horizontal component for supporting said mounting assembly on said arm and for cooperating with said locking means in clamping relationship to said horizontal component.

5. A wheelchair work tray multipivotal mounting assembly as set forth in claim 4, said barrier means being interconnected to said plates and oriented such that said engaging structure and said barrier means lie in an angular relationship, said engaging structure being oriented in complementary abutment with said substantially horizontal component and said barrier structure being oriented in complementary abutment with said substantially vertical component for inhibiting rotation of said mounting assembly about a normally substantially horizontal axis.

6. A wheelchair work tray multipivotal mounting assembly as set forth in claim 1 wherein said receiving means are positioned forwardly of said barrier.

7. A wheelchair work tray multipivotal mounting assembly as set forth in claim 6 wherein said locking means is swingably mounted on said retaining means.

8. A wheelchair work tray multipivotal mounting assembly as set forth in claim 7 wherein said locking means includes a pivotable cam oriented for engaging a portion of said arm, said barrier being oriented for engagement with said arm in a direction opposing said cam.

9. A wheelchair work tray multipivotal mounting assembly as set forth in claim 8 wherein said spaced apart members comprise first and second plates and said locking means includes means for retaining said locking assembly in a closed position relative to said first and second plates.

10. A wheelchair work tray multipivotal mounting assembly as set forth in claim 9 wherein said means for retaining said locking assembly in a closed position includes an eccentric oriented for engaging said second plate when said cam is pivoted into engagement with said arm.

11. A wheelchair work tray multipivotal mounting assembly as set forth in claim 10 wherein said tray supporting mount receiving means defines a substantially vertically aligned bore adapted for vertical adjustment of said tray supporting mount.

12. A wheelchair work tray multipivotal mounting assembly adapted for mounting on a wheelchair armrest, said assembly comprising;

first and second plate members;

said first plate member defining an access opening therein;

barrier means interconnecting said plate members in a fixed, spaced relationship and defining an entrance opening between said plates in opposing relationship to said barrier means, said entrance opening being configured for receiving therein armrest structure comprising a pair of adjacent arm rest defining structural elements positioned in intersecting orientation with respect to each other;

a door swingably mounted on said first plate between a first, open position and second, access opening-closing position;

a selectively engageable locking assembly mounted on said door and pivotally mounted on said door for engagement with said second plate when said door is in said access opening-closing position, said locking assembly including a cam mounted to an axle, said axle being pivotal with respect to said door for engaging said cam with said armrest proximate the region of intersecting orientation between said structural elements when said door is closed; and a receiver mounted to at least one of said plate members for releasably receiving a supporting element.

13. A wheelchair work tray multipivotal mounting assembly as set forth in claim 12 including lever arm mounted on said axle.

14. A wheelchair work tray multipivotal mounting assembly as set forth in claim 12 including means for retaining said lever arm against pivoting relative to said plate members.

15. A wheelchair work tray multipivotal mounting assembly as set forth in claim 12 wherein said receiver includes a tubular member having a bore therein.

16. A wheelchair work tray multipivotal mounting assembly as set forth in claim 15 wherein said bore is substantially vertically oriented.

17. A wheelchair work tray multipivotal mounting assembly as set forth in claim 12 wherein said plate members are substantially vertically oriented having top marginal edges thereof, a portion of said top marginal edge of the first plate being flanged toward the second plate and the top marginal edge of said second plate being flanged toward said first plate.

* * * * *